US006911861B2

(12) United States Patent
Deng

(10) Patent No.: US 6,911,861 B2
(45) Date of Patent: Jun. 28, 2005

(54) CURRENT BIASING CIRCUIT WITH TEMPERATURE COMPENSATION AND RELATED METHODS OF COMPENSATING OUTPUT CURRENT

(75) Inventor: Yuanying Deng, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/636,102

(22) Filed: Aug. 7, 2003

(65) Prior Publication Data

US 2005/0030090 A1 Feb. 10, 2005

(51) Int. Cl.[7] ..... G05F 1/10

(52) U.S. Cl. ..... 327/513; 327/539

(58) Field of Search ..... 327/512, 513, 327/530, 534, 535, 537, 538, 539

(56) References Cited

U.S. PATENT DOCUMENTS 6,459,326 B2 * 10/2002 Descombes ..... 327/513

OTHER PUBLICATIONS

Banba et al., A CMOS Bandgap Reference Circuit with Sub–1–V Operation, IEEE Journal of Solid State Circuits, May 1999, 670–674, vol. 34. No. 5.

* cited by examiner

*Primary Examiner*—Jeffrey Zweizig
(74) *Attorney, Agent, or Firm*—Ronald O. Neerings; Wade James Brady, III; Frederick J. Telecky, Jr.

(57) ABSTRACT

This disclosure provides, in one aspect, a current signal generating circuit for generating a current source for use by on- or off-chip components. In one embodiment, the circuit comprises an on-chip output current circuit configured to generate an output current and a reference current based on an input voltage. In this embodiment, the output current is substantially proportional to the reference current. The circuit also includes an on-chip resistive element coupled to the output current circuit and having a resistance configured to regulate the output current using the reference current. In such an embodiment, the resistance varies according to a temperature of the resistive element. In addition, the circuit includes an on-chip temperature compensation circuit coupled to the output current circuit and the on-chip resistive element, and configured to compensate for the varying resistance by adjusting the reference current in accordance with the varying resistance of the resistive element. Related methods of compensating for a current source used by on- or off-chip components are also disclosed.

19 Claims, 3 Drawing Sheets

CURRENT BIASING CIRCUIT WITH TEMPERATURE COMPENSATION AND RELATED METHODS OF COMPENSATING OUTPUT CURRENT

TECHNICAL FIELD OF THE INVENTION

Disclosed embodiments herein relate generally to circuits for generating current biasing signals, and more specifically to current biasing circuits with temperature compensation capabilities and related methods of compensating current source signals.

BACKGROUND OF THE INVENTION

In integrated circuit (IC) chip design, components and circuitry formed therein are typically operated using a variety of signals, including reference signals. In addition, certain components operate based on voltage signals, while other components are designed to function based on current signals. Moreover, as the complexity of integrated circuits continues to increase, the more important the accuracy of such voltage and current signals becomes. One problem that typically affects the accuracy of current signals in IC chips is the impact temperature has on components used to generate the current signals. Since avoiding temperature fluctuations altogether is typically not possible, steps must be taken to minimize the effects of temperature fluctuation among the circuitry used to generate the current signals.

BRIEF SUMMARY OF THE INVENTION

The disclosed embodiments provide, in one aspect, a current signal generating circuit for generating a current source for use by on- or off-chip components. In one embodiment, the circuit comprises an on-chip output current circuit configured to generate an output current and a reference current based on an input voltage. In this embodiment, the output current is substantially proportional to the reference current. The circuit also includes an on-chip resistive element coupled to the output current circuit and having a resistance configured to regulate the output current using the reference current. In such an embodiment, the resistance varies according to a temperature of the resistive element. In addition, the circuit includes an on-chip temperature compensation circuit coupled to the output current circuit and the on-chip resistive element, and configured to compensate for the varying resistance by adjusting the reference current in accordance with the varying resistance of the resistive element.

In another aspect, the disclosed embodiments also provide a method of compensating for a current source used by on- or off-chip components. In one embodiment, the method comprises generating an output current and a reference current based on an input voltage, where the output current is substantially proportional to the reference current. In addition, the method includes regulating the output current with the reference current using a resistance of an on-chip resistive element. In this embodiment, the resistance varies according to a temperature of the resistive element. The method further includes compensating for the varying resistance by adjusting the reference current in accordance with the varying resistance of the resistive element.

BRIEF DESCRIPTION OF THE DRAWINGS

Reference is now made to the following detailed description taken in conjunction with the accompanying drawings.

It is emphasized that various features may not be drawn to scale. In fact, the dimensions of various features may be arbitrarily increased or reduced for clarity of discussion. In addition, it is emphasized that some components may not be illustrated for clarity of discussion. Reference is now made to the following descriptions taken in conjunction with the accompanying drawings, in which.

DETAILED DESCRIPTION OF THE INVENTION

Figure 1:
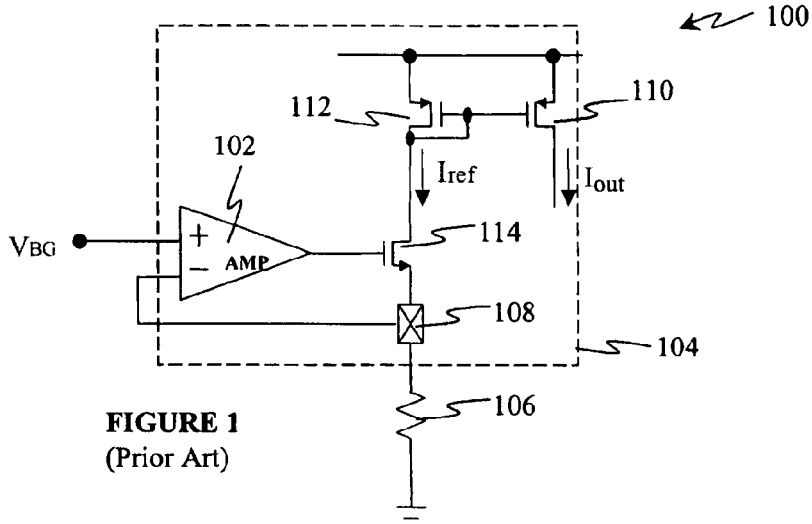
FIGURE 1 (Prior Art)
FIG. 1 illustrates a circuit diagram of one embodiment of a conventional current signal generating circuit.

For an understanding of the principles disclosed herein, a look at conventional approaches is first explored. Thus, looking initially at FIG. 1, illustrated is one embodiment of a conventional current signal generating circuit 100. As mentioned above, the circuit 100 may be used for generating an output current that may be used by various components in an integrated circuit chip, for example, as a reference signal for circuit biasing.

The circuit 100 includes a differential amplifier 102 within an output current circuit 104 having various other components as well. In addition, the circuit 100 includes a resistive element 106, coupled to the output current circuit 104 via a bond pad 108. The output current circuit 104 includes first and second opposing transistors 110, 112, having their gates coupled together, and driven by a third transistor 114. The third transistor 114 has its gate coupled to the output of the amplifier 102 to be driven as needed. A band-gap voltage $V_{BG}$ is input to the amplifier 102, along with a signal taken from the bond pad 108, and the result is used to drive the third transistor 114.

In function, a reference current $I_{ref}$ is regulated by the resistance of the resistive element 106, and is also used as a negative input signal to the amplifier 102. The amplifier 102 compares the voltage across the resistive element 106 created by the reference current $I_{ref}$ and the band-gap voltage $V_{BG}$ and outputs a signal that adjusts the third transistor 114. As the reference current $I_{ref}$ is adjusted, an output current $I_{out}$, which is a mirror of the reference current $I_{ref}$, is generated using the first and second transistors 110, 112 and output from the output current circuit 104 for use by other appropriate components in the chip as a current biasing signal.

The bond pad 108 is employed since the resistive element 106 is located off-chip, as is often seen in conventional circuit design. By employing an off-chip resistive element, the output current $I_{out}$ generated by the output current circuit 104 is less affected by any temperature fluctuation on the chip or within the resistive element 106 itself, whose temperature coefficient is negligible in most embodiments. Specifically, by being located off-chip, the resistive element 106 may be a large temperature independent resistor or resistor array, or even an active load. Although usually successful in avoiding temperature-based deficiencies, off-chip resistive elements are typically more expensive to manufacture and add steps to the manufacturing process. In addition, overall device size is not minimized when employing off-chip designs.

In alternative conventional designs, the resistive element 106 may be located on-chip, typically in the form of a semiconductor resistor array. However, process variations, as well as other causes, usually result in semiconductor resistors whose operation is impacted by their own temperature shifts. Specifically, such temperature shifts in on-chip resistors typically impact the output current $I_{out}$ generated by the circuit 100. In many cases, as the temperature of the resistive element 106 increases, the output current $I_{out}$ decreases due to constricted current flow therethrough. Of course, fluctuations in the output current signal $I_{out}$, which is used by other components as a biasing signal, can severely impact the operation of those other components, often to the detriment of the entire chip.

Figure 2:
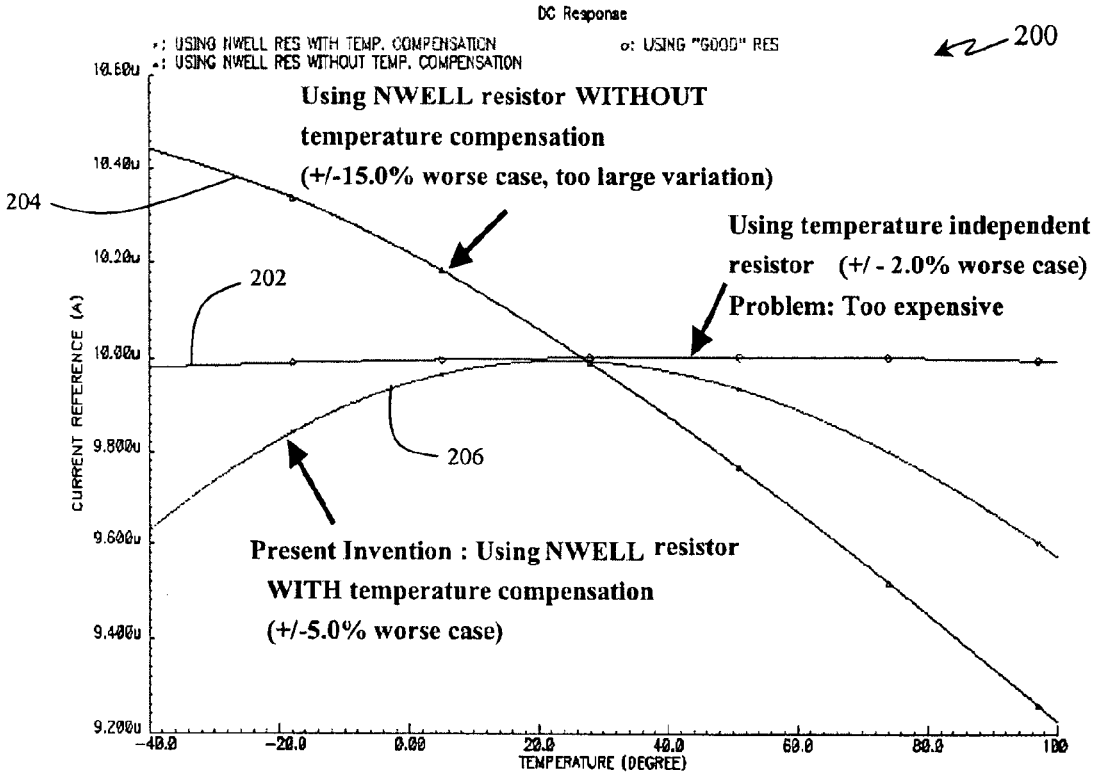
FIG. 2 illustrates a graph showing a comparison of multiple current signals for use as a reference current by components within an IC chip and its off-chip components.

Referring now to FIG. 2, illustrated is a graph 200 illustrating a comparison of multiple current signals for use as a reference current by components within an IC chip. In the graph 200, the X-axis displays typical operating temperatures, ranging from −40° C. to 100° C., and the Y-axis displays the current reference signal in Amps, ranging from 9.2 $\mu$a to 10.6 $\mu$a. The graph 200 illustrates a current reference signal with and without temperature compensation, as well as on-chip versus off-chip resistive elements.

First, plot 202 illustrates a plot of the current reference signal when an off-chip, temperature independent resistor (or resistor array) is employed. As may be seen by the plot 202, the current reference signal is substantially horizontal, for the illustrated operating temperature range. However, as discussed above, such off-chip resistive elements are relatively expensive to manufacture, both because of the location of the resistive element (i.e., off-chip) and the cost of the resistive element itself. Moreover, valuable circuit board real estate is occupied by such off-chip resistive elements, limiting the decrease in product size that may be possible.

Plot 204 illustrates a plot of the current reference signal when an on-chip resistive element is employed. Typically, such on-chip resistive elements are formed from one or more semiconductor resistors manufactured along with other circuitry in the IC chip. As a result, the manufacturing costs associated with forming the on-chip resistors or resistor array are typically less than with off-chip resistive elements. However, as also mentioned above, conventional on-chip resistive elements are usually susceptible to temperature fluctuations if manufactured without an additional fabrication mask, which often overly increases the overall costs of manufacturing. Specifically, as the operating temperature of the on-chip resistive element increases, the current allowed to pass therethrough decreases. Thus, as the plot 204 illustrates, as the operating temperature of the on-chip resistive element increases, the current reference signal typically experiences a sharp drop, which detrimentally affects overall device performance by affecting the biasing of local components relying on the signal for circuit operation.

Looking finally at plot 206, illustrated is a plot of the current reference signal when an on-chip resistive element is employed, similar to that used for plot 204, but also with the use of temperature compensation circuitry constructed according to the principles disclosed herein. By employing such temperature compensation circuitry, the current fluctuation (typically, a drop) may be overcome by introducing a current proportional to the absolute temperature ($I_{ptat}$) to compensate for the drop in current. Since the current $I_{ptat}$ introduced is proportional to the absolute operating temperature experienced by the resistive element, the compensation for the fluctuating current reference signal $I_{ref}$ (and thus the output current $I_{out}$) is offered in a dynamic and active manner, tracking the changes in current flow through the resistive element across the typical operating temperature range illustrated. As a result, a fluctuation of +/−5%, and in many cases +/−2.5%, may be maintained during operation, far improved from the typical +/−15% variation when an on-chip resistive element without temperature compensation is employed. As illustrated, in an advantageous embodiment, an overall variation of only about 0.4 $\mu$a occurs across the typical operating temperatures (e.g., from 9.6 $\mu$a at −40° C. to about 10 $\mu$a at 20° C., and then drops back to about 9.6 $\mu$a at 100° C.). Moreover, by providing an on-chip resistive element, the manufacturing expense and lost circuit board real estate associated with off-chip temperature independent resistive elements may be avoided.

Figure 3:
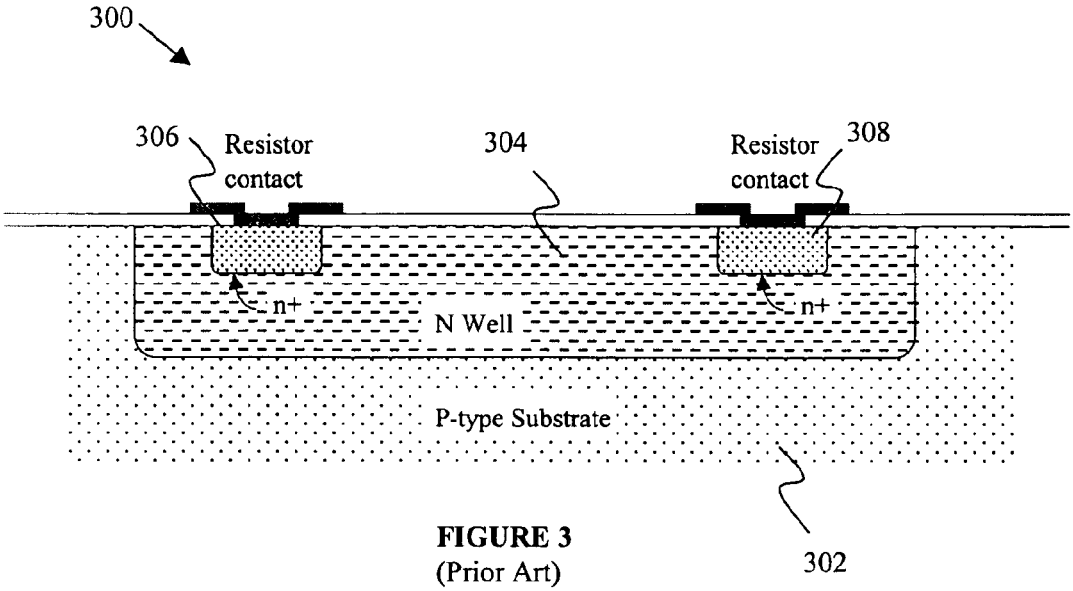
FIGURE 3 (Prior Art)
FIG. 3 illustrates a cross-section view of an N-well resistor that may be employed as the on-chip resistive element for a current signal generating circuit.

Turning briefly to FIG. 3, illustrated is a cross-section view of an N-well resistor 300 that may be employed as the on-chip resistive element for a current signal generating circuit constructed according the principles disclosed herein. The resistor 300 is manufactured on a semiconductor substrate 302. In this embodiment, the substrate 302 is a P-type substrate 302, but other embodiments are not so limited. Formed on the substrate 302 is an N-well 304. The resistor 300 is formed by heavily adding N-doped ends to an area connecting the two electrodes 306, 308 of the resistor 300. Those electrodes, 306, 308 are then coupled to resistor contacts for electrical coupling to other components in the IC chip.

In one embodiment, an array of trimmable resistors is employed as the on-chip resistive element, where the trimming occurs as part of the manufacturing process (e.g., employing "fuses"). By employing such common resistor arrays, however, any temperature variation compensation cannot be provided by simply adjusting the resistor array itself, since once the resistance of the resistive element is set (e.g., the fuse is broken) the impedance of the resistors can no longer be altered. However, an advantage to employing such resistors with a current signal generating circuit according to the principles herein is the ability to compensate for some process variation that typically occurs in the formation of the resistors 300. Such advantages are well documented, and explain in part the desire to employ on-chip resistive elements rather than off-chip.

Figure 4:
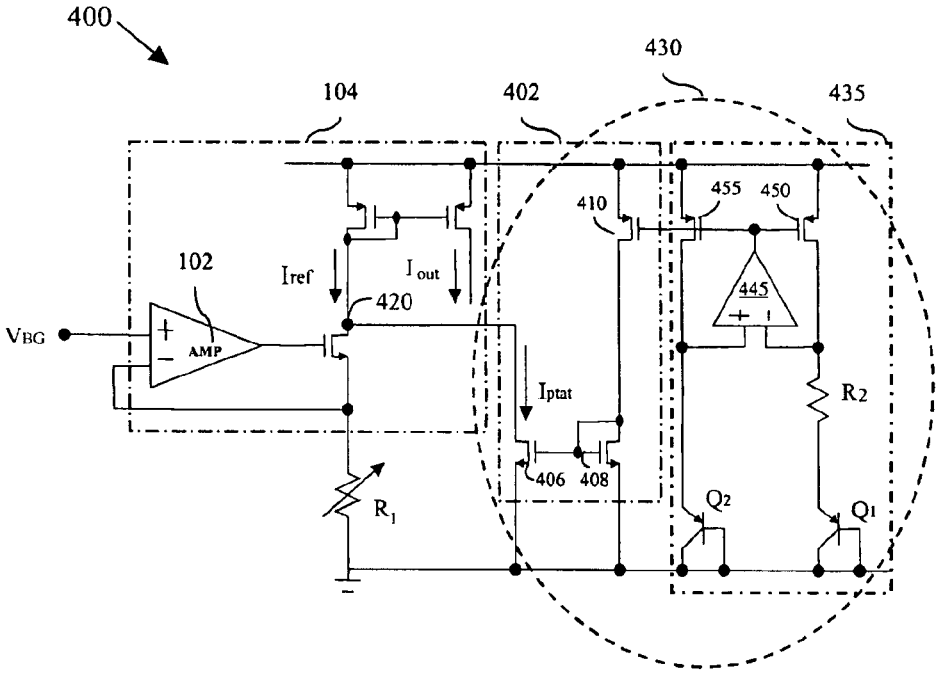
FIG. 4 illustrates a circuit diagram of one embodiment of a current signal generating circuit constructed according to the principles disclosed herein.

Looking now at FIG. 4, illustrated is one embodiment of a current signal generating circuit 400 constructed according to the principles disclosed herein. The circuit 400 is provided for generating an output current $I_{out}$ that may be used by various components in an integrated circuit chip, such as for a reference/biasing signal. The circuit 400 includes the differential amplifier 102, as well as the first and second opposing transistors 110, 112 with their gates coupled together and driven by the third transistor 114, in the output current circuit 104. The third transistor 114 has its gate coupled to the output of the amplifier 102 to drive the transistor 114 as needed. Also, the circuit 400 includes a resistive element in the form of an on-chip resistor array $R_1$, coupled to amplifier 102 and the output current circuit 104.

As in the conventional circuit 100 of FIG. 1, a band-gap voltage $V_{BG}$ is input to the amplifier 102, along with a reference current $I_{ref}$, and the result is used to drive the third transistor 114.

In contrast to the circuit 100 in FIG. 1, the reference current $I_{ref}$ is not entirely regulated by the on-chip resistive element $R_1$. Specifically, due to the temperature fluctuations that inevitably occur in the resistive element $R_1$, a high temperature coefficient cancellation is provided for the resistive element $R_1$ by temperature compensation circuitry 430 coupled to the output current circuitry 104 and the on-chip resistive element $R_1$. In accordance with the principles disclosed herein, the temperature compensation circuitry 430 is configured to generate a compensation current for compensating the regulation of the output current $I_{out}$ (using the reference current $I_{ref}$) based on a temperature of the on-chip resistive element $R_1$. As illustrated, the compensation current is a current proportional to absolute temperature $I_{ptat}$, and is drawn from the reference current $I_{ref}$ generated by the current output circuit 104. The current proportional to absolute temperature $I_{ptat}$ literally means a current that increases as the temperature increases (i.e., proportionally) within the device (e.g., in the resistive element $R_1$).

In function, the reference current $I_{ref}$ may be adjusted by the on-chip resistive element $R_1$, as found in conventional circuit arrangements. However, as the temperature of the resistive element $R_1$ increases, the reference current $I_{ref}$ allowed to flow therethrough begins to drop causing the output current $I_{out}$, which is mirrored from the reference current $I_{ref}$, to proportionately drop. Thus, in the novel circuit 400 of FIG. 4, the temperature compensation circuitry 430 draws the current proportional to absolute temperature $I_{ptat}$ from node 420 to assist in regulating the reference current $I_{ref}$, thus regulating the output current $I_{out}$, in spite of a current drop across the on-chip resistive element $R_1$.

To draw the current proportional to absolute temperature $I_{ptat}$ as needed, the temperature compensation circuitry 430 includes fourth and fifth transistors 406, 408 having their gates coupled together. The sources of these transistors 406, 408 are coupled to ground, as shown in FIG. 4. While the drain of the fourth transistor 406 draws the current proportional to absolute temperature $I_{ptat}$, the drain of the fifth transistor 408 is coupled to the source of a current mirror transistor 410, and the three transistors form a current mirror (or "doubler") circuit 402 within the temperature compensation circuit 430. The current mirror circuit 402 is employed to mirror the originally generated current proportional to absolute temperature $I_{ptat}$, which is generated by IPTAT Circuitry 435 and mirrored for use in the current/temperature compensation described above. The mirror circuit 402 also serves to advantageously change the direction of the current flowing through mirror transistor 410, as those who are skilled in the art will understand.

To generate the current proportional to absolute temperature $I_{ptat}$, the IPTAT circuitry 435 includes first and second bipolar junction transistors $Q_1$, $Q_2$. While transistors $Q_1$, $Q_2$ are illustrated as bipolar junction transistors (BJTs), and the rest of the transistors in the circuit 400 as field-effect transistors (FETs), any appropriate type of transistor or other active device may be incorporated without limitation. As illustrated, the bases and collectors of transistors $Q_1$, $Q_2$ are both coupled together to ground. However, the emitters of transistors $Q_1$, $Q_2$ are coupled to respective inputs of a second differential amplifier 445, with the emitter of transistor $Q_1$ coupled via a second resistive element $R_2$. In addition, the emitters of transistors $Q_1$ (via a second resistive element $R_2$), $Q_2$ are directly coupled to the drains of seventh and eighth transistors 450, 455. The gates of transistors 450, 455 are coupled together to the output of the second amplifier 445 and to the gate of the mirror transistor 410, while the sources of transistors 450, 455 are coupled to the source of the mirror transistor 410.

To implement the circuit 400, a temperature coefficient associated with transistors $Q_1$, $Q_2$ should be considered. In an exemplary embodiment, transistor $Q_1$ would be about eight times bigger emitter area (e.g., having eight times smaller collector current density, which is defined as the collector area divided by the emitter area,) than transistor $Q_2$, but this precise ratio is not required. This is to provide transistors having significantly different sizes such that their base-to-emitter voltage $V_{BE1}$ and $V_{BE2}$ does not change equally relative to any temperature changes. Specifically, a $V_{BE2}$ minus $V_{BE1}$ delta voltage $V\Delta$ is proportional to absolute temperature. This proportionality is quite accurate and holds even when the collector currents are temperature dependent, as long as their density ratio remains fixed. Therefore, as temperature increases, a $V_{BE2}$ minus $V_{BE1}$ delta voltage $V\Delta$, which is equal to the voltage across the resistive element $R_2$, is established.

With the emitters of transistors $Q_1$, $Q_2$ coupled to the second resistive element $R_2$ and transistor 455, respectively, as well as to the inputs of amplifier 445, an amplification is provided such that the voltage across the resistive element $R_2$ is equal to the voltage differential $V\Delta$, which is relative to the temperature variations of transistor $Q_1$, $Q_2$. As a result, the current through the resistive element $R_2$, as well as the current carried through transistors 410, 455, and 450, is established by the changing temperatures of transistors $Q_1$, $Q_2$, as well as the corresponding size difference between the two. The amplifier 445 will continue to drive current through transistors 450, 455, and thus necessarily through the mirror transistor 410, through a continued effort to equalize the voltage differential of the positive terminal voltage and negative terminal voltage.

Thus, the amplifier 445 will continue to drive whatever current is necessary through transistor 450 in order to make the negative terminal voltage of the amplifier 445 the same as its positive terminal voltage. That current will, in turn, necessarily be drawn through transistor 455 (e.g., the gates are tied together and both are the same size), and then be mirrored through mirror transistor 410. The mirrored current will then drive the gate of transistor 408, as well as the gate of transistor 406, resulting in the current proportional to absolute temperature $I_{ptat}$ being drawn from node 420 and compensating for any current drop caused by temperature fluctuations in the on-chip resistive element $R_1$. The precise relationship between the temperature fluctuations in the resistance of the resistive element $R_1$ and transistors $Q_1$, $Q_2$ is explored in greater detail below, with reference to equations (1) through (6).

In an exemplary embodiment, transistors 450 and 455 are substantially equal, but this is not always required. However, when they are substantially equal, if the gates and sources of the transistors 450, 455 are coupled together, as their gates are biased properly each transistor 450, 455 draws essentially the same current. Also in such embodiments, the mirror transistor 410 need not be equal to transistors 450, 455, and its value will typically vary depending on the amount of current draw desired therethrough. More specifically, this value will vary based in part on the design needs of the circuit 400, as well as the amount of compensation needed and the amount of output current $I_{out}$ to be provided by the output current circuit 104.

In one embodiment, the circuit components used to form the IPTAT circuitry 435, and perhaps even the mirror circuit 402, already exists in the same IC chip already housing the rest of circuit 400. More specifically, process steps may simply be modified to couple components already slated to be formed in the chip, in order to create various components of the temperature compensation circuitry 430. In such an embodiment, any expense associated with constructing all new components for any of the circuitry 430 is reduced or eliminated, since existing components are employed and merely coupled in a different manner. In a more specific embodiment, components within the circuitry used to generate the band-gap voltage $V_{BG}$ may be employed as some or all of the components of the temperature compensation circuitry 430, but other embodiments are not so limited.

In conventional current signal generating circuits (e.g., circuit 100 of FIG. 1), the output current $I_{out}$ is equal to $V_{BG}/R$, with $V_{BG}$ supplied from a band-gap voltage reference signal. However, in the present disclosure, the off-chip resistive element is replaced with a low-cost on-chip resistive element, such as the N-well resistor array $R_1$ shown in FIG. 4. With this circuit layout, the following relationships apply if sufficient gain is provided by the amplifier 445 in the IPTAT circuitry 435:

$$I_{out} = I_{ref} = \frac{V_{BG}}{R_1} + I_{ptat}, \text{ and} \tag{1}$$

$$I_{ptat} = \frac{V_{BE(Q2)} - V_{BE(Q1)}}{R_2} = \frac{KT}{qR_2}\ln\frac{A_{E1}I_{C(Q2)}}{A_{E2}I_{C(Q1)}}, \tag{2}$$

where KT/q is the thermal voltage, which is proportional to absolute temperature (PTAT), $A_{E1}$ and $A_{E2}$ are the emitter area of transistors $Q_1$ and $Q_2$, respectively, and $I_{C(Q1)}$ and $I_{C(Q2)}$ are the collector currents of transistors $Q_1$ and $Q_2$, respectively. Resistive elements $R_1$ and $R_2$ are both N-well resistor arrays with the following relationship with in a given set of manufacturing process parameters:

$$\rho \propto \frac{1}{q \cdot \int_0^{depth} \mu_{well} \cdot N_{well}\, dx} \tag{3}$$

where $\mu_{well}$ is the electron mobility in the range of the depth of the N-well, and $N_{well}$ is the doping profile, which is typically well controlled in the manufacturing process. These process parameters are subject to the absolute temperature variation, such that the N-well resistors are temperature dependent. The temperature dependency of the N-well resistors is well established and modeled in SPICE (Simulation Program with Integrated Circuit Emphasis) in the following format:

$$R = R_{@298k} * [1 + TC_1 * (T-298) + TC_2 * (T-298)^2], \tag{4}$$

where $R_{@298k}$ is the resistance in room temperature, and $TC_1$ is the linear temperature coefficient of the modeled resistor, which is typically about 1700 PPM/° C. for N-well resistors. In addition, $TC_2$ is the second order temperature coefficient, which in most embodiments is relatively small. For that reason, its effect is ignored in the present exemplary analysis. At a particular absolute temperature T, $V_{BG}/R$ in equation (1) has a negative temperature coefficient of:

$$-\frac{TC_1}{1 + TC_1(T-297)} \cdot 100\%/°\text{C}. \tag{5}$$

while $I_{ptat}$ gives the positive temperature coefficient:

$$+\frac{1}{T} \cdot \frac{1 - TC_1 \cdot 298}{1 + TC_1 \cdot (T-297)} \cdot 100\%/°\text{C}. \tag{6}$$

According to the $TC_1$ specification and equations (5) and (6), by adjusting the ratio of the two summing terms in equation (1), the derivative of $I_{out}$ with respect to temperature can be found to be zero at room temperature. Thus, as a result of the above, employing the principles disclosed herein will result in an arc across the typical operational temperature range of −40° C. to 100° C., as shown in FIG. 5B.

Figures 5A, 5B:
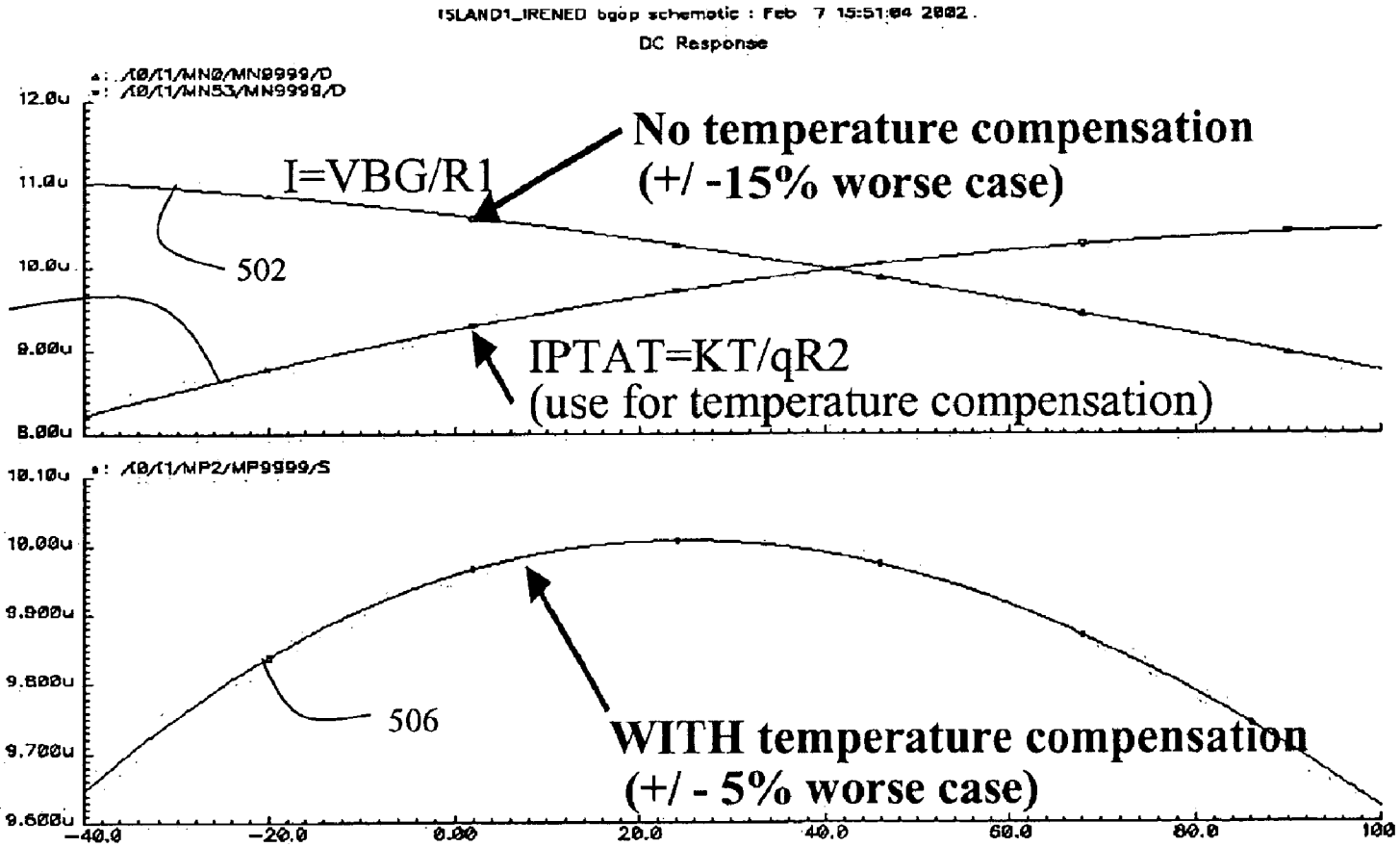
FIG. 5A illustrates two current plots related to providing temperature compensation.
FIG. 5B illustrates a plot of the reference current, mirrored as the output current, when an on-chip resistive element is employed along with temperature compensation circuitry.

Looking now at FIG. 5A, illustrated are two current curves related to providing temperature compensation in the manner disclosed herein. Specifically, the first curve 502 illustrates a plot of the output current $I_{out}$ when no temperature compensation is employed. The second curve 504 illustrates the current proportional to absolute temperature $I_{ptat}$ generated by IPTAT circuitry constructed according to the principles discussed above. As with plot 204 in FIG. 2, plot 502 illustrates that as the operating temperature of the on-chip resistive element increases, the current reference signal typically experiences a current drop, which detrimentally affects overall device performance. Plot 504 illustrates the current proportional to absolute temperature $I_{ptat}$ generated in the IPTAT circuitry, which is employed to compensate for the dropping current plot 502.

Turning finally to FIG. 5B, illustrated is a plot 506 of the reference current $I_{ref}$, mirrored as the output current $I_{out}$, when an on-chip resistive element is employed along with temperature compensation circuitry described above. By employing the temperature compensation circuitry disclosed herein, the current drop may be overcome by introducing the current proportional to the absolute temperature ($I_{ptat}$) to compensate for the drop in current. As a result, a fluctuation of +/−5%, as a worst-case scenario, and in many cases +/−2.5%, may be maintained during operation, far improved from the +/−15% variation when an on-chip resistive element without temperature compensation is employed. In addition, the temperature compensation circuitry allows the use of an on-chip resistive element, thus reducing overall manufacturing costs, as well as saving valuable circuit board real-estate typically occupied by off-chip temperature independent resistive elements.

Moreover, while plot 506 illustrates an arc/curve symmetrical across the plotted operating temperature range, in other embodiments the plot 506 is not necessarily symmetrical. More specifically, varying process environments, caused from variations that may occur during various stages of the manufacturing process, may cause non-linear current drops or increases (e.g., plots 502 and/or 504) during device operation. As a result of such potential process variations, the "peak" of the output current $I_{out}$ (plot 506) may be skewed to either the lower or upper end of the range of operating temperatures. However, no matter where the peak falls within the range of operating temperatures, a maximum variation (e.g., worst-case) of only about ±5% may still be realized. Therefore, this beneficially allows the incorporation of the principles disclosed herein into existing manufacturing processes, without a need to significantly alter these processes to maintain the desirable results described herein.

While various embodiments of temperature compensation circuitry, as well as methods of compensating for current drops caused by temperature fluctuations, have been described above, it should be understood that they have been presented by way of example only, and not limitation. Thus, the breadth and scope of the invention(s) should not be limited by any of the above-described exemplary embodiments, but should be defined only in accordance with the following claims and their equivalents. Moreover, the above advantages and features are affected in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field of the Invention," the claims should not be limited by the language chosen under this heading to describe the so-called field of the invention. Further, a description of a technology in the "Background of the Invention" is not to be construed as an admission that technology is prior art to any invention(s) in this disclosure. Neither is the "Brief Summary of the Invention" to be considered as a characterization of the invention(s) set forth in the claims set forth herein. Furthermore, the reference in these headings, or elsewhere in this disclosure, to "invention" in the singular should not be used to argue that there is only a single point of novelty claimed in this disclosure. Multiple inventions may be set forth according to the limitations of the multiple claims associated with this disclosure, and the claims, and their equivalents, accordingly define the invention(s) that are protected thereby. In all instances, the scope of the claims shall be considered on their own merits in light of the specification, but should not be constrained by the headings set forth herein.

What is claimed is:

1. A current signal generating circuit for generating a current source for use by on- or off-chip components, the circuit comprising:

an on-chip output current circuit configured to generate an output current and a reference current based on an input voltage, the output current substantially proportional to the reference current;

an on-chip resistive element coupled to the output current circuit and having a resistance configured to regulate the output current using the reference current, the resistance varying according to a temperature of the resistive element; and an on-chip temperature compensation circuit coupled to the output current circuit and the resistive element, and configured to compensate for the varying resistance by adjusting the reference current in accordance with the varying resistance of the resistive element by bypassing a flow of the reference current through the on-chip resistive element.

2. A current signal generating circuit according to claim 1, wherein the on-chip temperature compensation circuit is configured to compensate for the varying resistance by adjusting the reference current using a current proportional to an absolute temperature of the on-chip resistive element.

3. A current signal generating circuit according to claim 2, wherein the temperature compensation circuit comprises amplification circuitry configured to generate the current proportional to an absolute temperature of the on-chip resistive element.

4. A current signal generating circuit according to claim 3, wherein the amplification circuitry comprises first and second transistors coupled to a differential amplifier, the differential amplifier configured to equalize respective current draws of the first and second transistors.

5. A current signal generating circuit according to claim 4, wherein the first transistor is capable of having eight times less current density as the second transistor.

6. A current signal generating circuit according to claim 4, wherein an output of the differential amplifier is coupled to the gates of opposing third and fourth transistors, the differential amplifier configured to equalize respective current draws of the first and second transistors using the opposing third and fourth transistors.

7. A current signal generating circuit according to claim 3, wherein the temperature compensation circuit further comprises current mirror circuitry coupled to the amplification circuitry, and configured to generate a compensation current mirroring the current proportional to an absolute temperature of the on-chip resistive element to adjust the reference current.

8. A current signal generating circuit according to claim 1, wherein the output current circuit is configured to generate an output current substantially equal to the reference current.

9. A method of compensating for a current source used by on- or off-chip components, the method comprising:

generating an output current and a reference current based on an input voltage with an on-chip output current circuit, the output current substantially proportional to the reference current;

regulating the output current with the reference current using a resistance of an on-chip resistive element, the resistance varying according to a temperature of the resistive element; and compensating for the varying resistance with an on-chip temperature compensation circuit coupled to the output current circuit and the on-chip resistive element, and configured to adjust the reference current in accordance with the varying resistance of the resistive element by bypassing a flow of the reference current through the on the on-chip resistive element.

10. A method according to claim 9, wherein compensating further comprises compensating for the varying resistance with an on-chip temperature compensation circuit configured to adjust the reference current according to the temperature of the on-chip resistive element by generating a current proportional to an absolute temperature of the on-chip resistive element.

11. A method according to claim 10, wherein compensating further comprises compensating for the varying resistance with an on-chip temperature compensation circuit having amplification circuitry configured to generate the current proportional to the absolute temperature of the on-chip resistive element.

12. A method according to claim 11, wherein the amplification circuitry comprises first and second transistors coupled to a differential amplifier, the method further comprising equalizing respective current draws of the first and second transistors using the differential amplifier.

13. A method according to claim 12, wherein the first transistor is capable of having eight times less current density as the second transistor.

14. A method according to claim 12, wherein an output of the differential amplifier is coupled to the gates of opposing third and fourth transistors, the method further comprising equalizing respective current draws of the first and second transistors using the opposing third and fourth transistors.

15. A method according to claim 10, wherein compensating further comprises compensating for the varying resistance with an on-chip temperature compensation circuit configured to adjust the reference current according to the temperature of the on-chip resistive element by generating a compensation current mirroring the current proportional to an absolute temperature of the on-chip resistive element.

16. A method according to claim 9, wherein generating an output current and a reference further comprises generating an output current substantially equal to the reference current.

17. A current signal generating circuit for generating a current source for use by on- or off-chip components, the circuit comprising:

an on-chip output current circuit configured to generate an output current and a reference current based on an input voltage, the output current substantially proportional to the reference current;

an on-chip resistive element including an array of on-chip semiconductor resistors coupled to the output current circuit and having a resistance configured to regulate the output current using time reference current, the resistance varying according to a temperature of the resistive element; and an on-chip temperature compensation circuit coupled to the output current circuit and the resistive element, and configured to compensate for the varying resistance by adjusting the reference current in accordance with the varying resistance of the resistive element.

18. A method of compensating for a current source used by on- or off-chip components, the method comprising:

generating an output current and a reference current based on an input voltage with an on-chip output current circuit, the output current substantially proportional to the reference current;

regulating the output current with the reference current using a resistance of an on-chip resistive element including an on-chip array of semiconductor resistors, the resistance varying according to a temperature of the resistive element; and compensating for the varying resistance with an on-chip temperature compensation circuit coupled to the output current circuit and the on-chip resistive clement, and configured to adjust the reference current in accordance with the varying resistance of the resistive element.

19. A current signal generating circuit for generating a current source for use by on- or off-chip components, the circuit comprising:

an on-chip output current circuit configured to generate an output current and a reference current based on an input voltage, the output current substantially proportional to the reference current;

an on-chip resistive element coupled to the output current circuit and having a resistance configured to regulate the output current using the reference current, the resistance varying according to a temperature of the resistive element; and an on-chip temperature compensation circuit coupled to the output current circuit and the resistive element, and configured to compensate for the varying resistance by adjusting the reference current in accordance with an absolute temperature of the resistive element, the on-chip temperature compensation circuit including amplification circuitry configured to generate the current proportional to an absolute temperature of the on-chip resistive element, the amplification circuitry comprising first and second transistors coupled to a differential amplifier, the differential amplifier configured to equalize respective current draws of the first and second transistors, wherein an output of the differential amplifier is coupled to the gates of opposing third and fourth transistors to equalize respective current draws of the first and second transistors, and wherein the first transistor is capable of having eight times less current density as the second transistor.

* * * * *